United States Patent [19]

Boyreau

[11] 3,980,323

[45] Sept. 14, 1976

[54] METHOD OF RECORDING AND IDENTIFYING INTELLIGENCE ON BANK CHECKS BY CATEGORY AND OF INDEXING CANCELLED BANK CHECKS BY CATEGORY FOR SUBSEQUENT USE

[75] Inventor: Marcel Boyreau, Lincolnwood, Ill.

[73] Assignee: Exchange National Bank of Chicago, Chicago, Ill.

[22] Filed: Jan. 17, 1974

[21] Appl. No.: 434,187

Related U.S. Application Data

[63] Continuation of Ser. No. 296,584, Oct. 11, 1972, abandoned.

[52] U.S. Cl. ..... 283/57; 283/58

[51] Int. Cl.[2] ..... B42D 15/00

[58] Field of Search ..... 283/57, 58

[56] References Cited

UNITED STATES PATENTS

| | | | |
|---|---|---|---|
| 1,552,879 | 9/1925 | Randolph | 283/58 X |
| 1,565,255 | 12/1925 | Byquist | 283/58 X |
| 1,646,033 | 10/1927 | May | 283/58 |
| 3,315,985 | 4/1967 | Hall et al. | 283/57 X |

*Primary Examiner*—Lawrence Charles
*Attorney, Agent, or Firm*—Dressler, Goldsmith, Clement, Gordon & Shore, Ltd.

[57] ABSTRACT

A method of preparing and maintaining accurate and useful records for use in preparing tax records in which indicators corresponding to predetermined categories of intelligence are marked on a bank check for later indexing by category in response to visual inspection of the marked indicator on the check.

1 Claim, 6 Drawing Figures

| CHECK NO. | DATE | DESCRIPTION | TAX CODE | | ✓ | BALANCE FORW. | |
|---|---|---|---|---|---|---|---|
| 507 | 6/10 | TO Some Hospital Plan | 1 | AMOUNT | | 29 | 19 |
| | | FOR | | NEW. BAL. | | | |
| | | TO | | | | | |
| | | FOR | | | | | |
| | | | | | | | |
| | | | | | | | |
| | | | | | | | |
| | | | | | | | |
| | | | | | | | |
| | | | | | | | |

METHOD OF RECORDING AND IDENTIFYING INTELLIGENCE ON BANK CHECKS BY CATEGORY AND OF INDEXING CANCELLED BANK CHECKS BY CATEGORY FOR SUBSEQUENT USE

This is a continuation of application Ser. No. 296,584, filed Oct. 11, 1972, now abandoned.

This invention relates to a new method for preparing and maintaining accurate and useful records in conjunction with the writing of bank checks, and particularly records which are useful to taxpayers in connection with the preparation and filing of income tax returns.

Millions of people utilize checking accounts for personal use and pay bills through those accounts. Many of the bank checks written on such accounts relate to items of cost and expense which are deductible on income tax returns, such as U.S. Income Tax Returns. Although such bank checks can be used in connection with preparing income tax returns, they are too frequently ignored and their significance is too frequently misunderstood, unknown or forgotten.

This invention provides the millions of check writers who fail to appreciate the tax consequences and significance of their daily check writing with a method and system of preparing, maintaining and indexing records which will be beneficial to them when it is time to prepare their tax returns.

The method of this invention is one by which intelligence is recorded and identified on bank checks by predetermined categories of intelligence for subsequent indexing by category and use. The method includes the steps of providing a list having a plurality of intelligence categories, each of said categories being denoted by a first indicator visibly distinct from each other first indicator, providing the face of a bank check with a plurality of second indicators, each of which is visibly distinct from each other second indicator, there being a first indicator corresponding to each second indicator which is on the face of the bank check, by reference to said list, selecting a first indicator corresponding to the one of those intelligence categories to which category the intended payee of the bank check to be written belongs, marking a second indicator on the face of a bank check which corresponds to the selected first indicator, thereby visually to identify the selected category of intelligence on the face of the bank check and visibly to distinguish that bank check from other bank checks in other of said categories, then, after the cancelled check is returned to the maker, indexing the bank check in accordance with the selected second indicator with other marked bank checks in response to inspection of said second indicator.

The method of this invention further contemplates providing a check register which defines a position in which a symbol corresponding to the selected first indicator is entered for identifying the location of a subsequently indexed bank check.

The method also contemplates the step of positioning the list of intelligence categories in a bank check folder pocket and positioning a book of bank checks in a pocket in that folder adjacent the list, whereby the list is readily visible as a bank check is being written. The book of checks is desirably one in which a plurality of bank checks is secured, each along a serrated line.

Further objects, features and advantages of this invention will become apparent from the following description and drawings, of which:

The system and method of this invention is carried out in conjunction with a series of tangible elements which are provided to permit implementation of the method.

Figure 2:
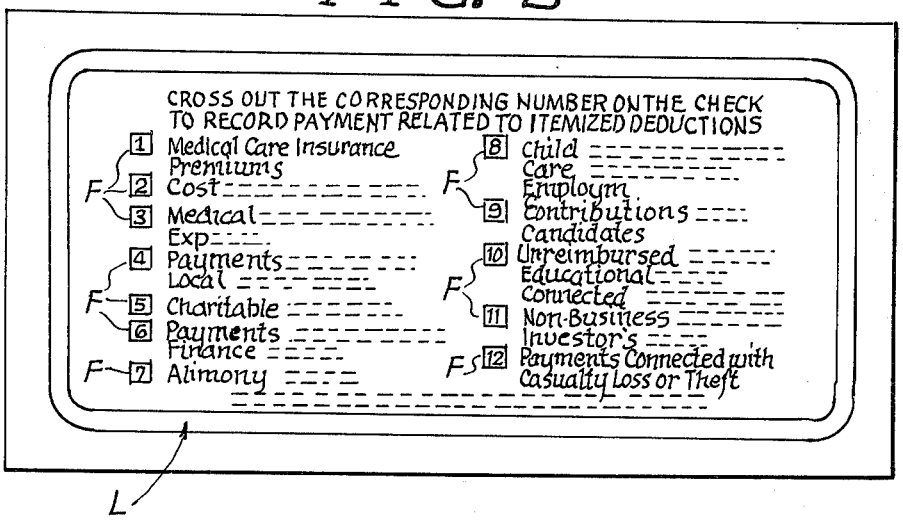
FIG. 2 is a plan view of a typical list of intelligence categories provided for use in connection with the practice of the method of this invention.

Referring first to FIG. 2, a list L displaying a plurality of intelligence categories is provided, as by imprinting the intelligence on a sheet of flexible material, such as paper. Each intelligence category is preferably briefly captioned and is associated with an adjacent first indicator F. In the embodiment illustrated, the first intelligence category is "Medical Care Insurance" denoted, in the overall system, by a first indicator "1," which is visibly distinct from each other. A typical list of intelligence categories which are presently useful in connection with determining deductions for preparing and filing a Schedule A to accompany Federal Income Tax Form 1040, an exemplary use of the system of this invention, are the following:

| First Indicator F | Intelligence Category |
|---|---|
| 1 | Medical Care Insurance Premiums |
| 2 | Cost of Medicine and Drugs |
| 3 | Medical, Hospital and Dental Expenses |
| 4 | Payments Including State, Local or Foreign Taxes |
| 5 | Charitable Contributions |
| 6 | Payments Including Interest or Finance Charges |
| 7 | Alimony Payments |
| 8 | Child or Disabled Dependent Care in Connection with Employment |
| 9 | Contributions to Political Candidates |
| 10 | Unreimbursed Business and Educational Expenses Connected with Employment |
| 11 | "Non-Business" Expenses or Investor's expenses |
| 12 | Payments Connected with Casualty Loss or Theft |

Other first indicators than numerals may be used and of course the intelligence categories may be other than items potentially deductible on a Form 1040 or may include both deductible and non-deductible items.

Figure 1:
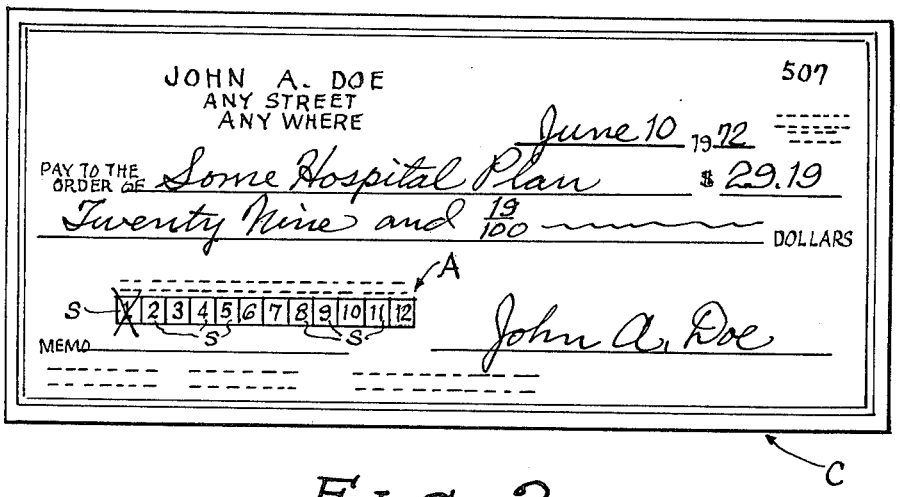
FIG. 1 is a plan view of a typical bank check which may be provided for use in connection with the practice of the method of this invention.
Figure 4:
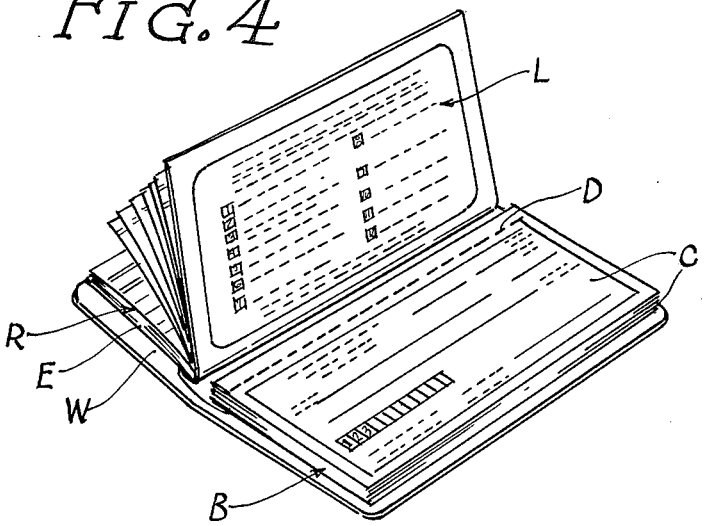
FIG. 4 is a perspective view of a check folder in which a check register bearing the list of FIG. 2 is inserted in one pocket and in which a book of bank checks is inserted and positioned adjacent the list for transport and use.

Referring now to FIGS. 1 and 4, a book or pad B of bank checks C is provided. Checks C are easily separated from pad B along a serrated line of detachment D. The face of each check which may be of any conventional form is additionally provided with a plurality of second indicators S, each of which is visibly distinct from each other second indicator S, there being a first indicator F corresponding to each of the second indicators S. Second indicators S, in the embodiment illustrated, are located in zone A and comprise a plurality of adjacent squares having the second indicators S which are numerals 1 through 12, inclusive, and each of which corresponds to a first indicator F. Of course, symbols or indicators other than numerals may also be used.

When a user of the system writes or makes a check C, he refers to the list of intelligence categories L and, if the payee of the check, or the party who is intended to receive the funds for which the check is being written, falls within one of the plurality of intelligence categories on the list L, then the user selects the corresponding first indicator F from the list. The corresponding second indicator S on the face of the check is then marked by the maker, thereby visually to identify the selected category of intelligence on the face of the check C, visibly to distinguish that check from other of the checks in other of the categories and from other checks that may fall outside of the list of categories. The mark may take the form of an "X" mark, such as that which has been superimposed on second indicator 1 on the check C in FIG. 1 by the user.

To assist the user of the system and method of this invention, a check register R (FIG. 4) may be provided with concise, easily understandable explanatory material describing the several intelligence categories in greater detail, for example explaining, as to intelligence category 2, what are the medicines and drugs that may be deductible on Federal Income Tax Form 1040, etc. The explanatory material E may be bound into the check register in a manner similar to the binding in of check register pages. This explanatory material may then be used in connection with reference to the list L for selection of that first indicator F which is to be used in connection with the writing of a check.

The second indicator having been marked, and the check having otherwise been appropriately made, it is then ready for use in a normal fashion.

Figure 5:
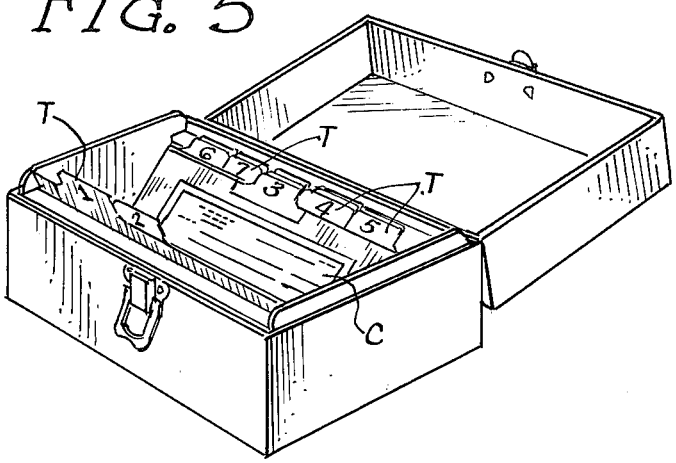
FIG. 5 is an indexing system in which cancelled checks which have been returned to the maker may be inserted and indexed in accordance with the intelligence category identified by each check.
Figure 6:
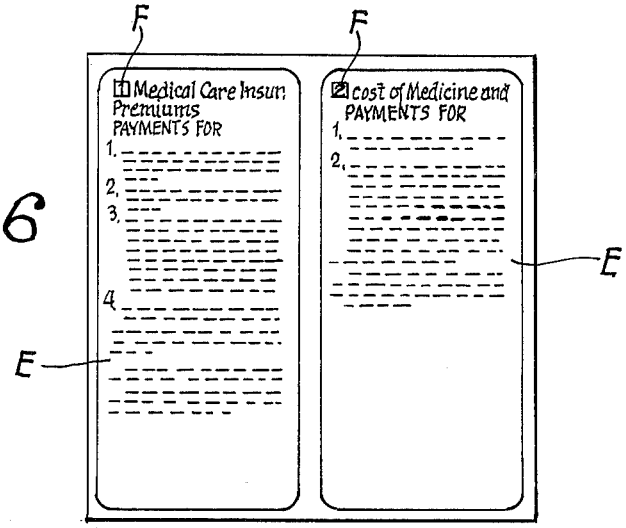
FIG. 6 shows explanatory material relative to the intelligence categories.

After a check so marked has been cancelled and returned by the bank, that check and all others returned may then be examined for indexing and filing. The checks are then sorted into categories in response to a visual inspection of the second indicators marked, and are indexed for future use. To index the checks which have been marked, it is convenient to place them in a file box having separators and third indicators T corresponding to second indicators S, between which separators the user of the system places the cancelled checks (see FIG. 5).

Figure 3:
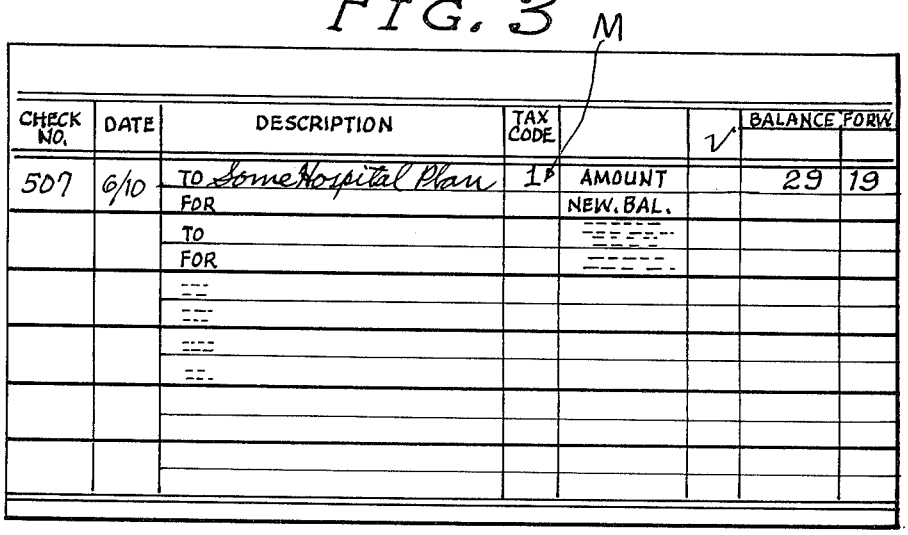
FIG. 3 is a plan view of a page of a typical check register provided for use in connection with the practice of the method of this invention.

So that the user of the system may readily locate indexed checks, a check register R used in connection with the system provides a location indicator, in which a symbol corresponding to the third indicator may be entered. The symbol may be a mark M made by the user which is the same as the second and third indicators, such as by entering the numeral 1 adjacent information identifying the subject matter of the check (see FIG. 3). That then provides a visual indication in the check register itself for identifying the location of a subsequently indexed check.

The check register R illustrated in FIG. 4 may be a booklet in which otherwise conventional check register pages are bound and in which the explanatory material referred to above is printed. Further, the list L may be provided on the check register as well (see FIG. 4). Alternatively, the list L may be imprinted on a separate sheet of material which is mounted for juxtaposition with a check book pad B.

So that the first indicators F are always readily available as checks are being written, advantageously a check folder or check wallet W is provided. The folder W provides pockets to receive an appropriately configured mounting tab, such as the paperboard backing sheet commonly associated with the pad B and a further pocket for receiving a similar tab or portion of a check register bearing the list L or a tab associated with a separate list L. In this manner the list L will always be open adjacent a check to be written and readily visible as a check is being written.

Although in connection with the description of the foregoing method in accordance with this invention it has been suggested that the second indicator on the face of the check be marked contemporaneously with the making of the check it will, of course, be apparent that the second indicator may be marked after cancelled checks have been returned to the maker.

The method of this invention provides a simple and readily usable system for all taxpayers by which they may easily maintain helpful records for use in connection with the preparation of income tax returns and a system by which taxpayers will be enabled to secure all proper deductions for expenses made by them during the course of a tax year.

Although there has been shown and described in detail one preferred embodiment of this invention, it is apparent that this invention is susceptible of embodiment in many different forms. The present disclosure is intended to be an exemplification of the principles of the invention and is not intended to limit the invention to the embodiment illustrated. The scope of the invention will be pointed out in the appended claims.

What is claimed is:

1. A method of recording and identifying tax deduction information on bank checks by category and of indexing cancelled bank checks by category for subsequent use, comprising the steps of providing a list having a plurality of tax deduction categories, each of said categories being denoted by a first indicator visibly distinct from each other first indicator, providing a check register booklet having a plurality of check register pages, providing a check book having a plurality of individual, conventional single part bank checks secured in said book, each of said checks being secured in said book along a serrated line, providing the face of each check with a plurality of second indicators, each of which is visibly distinct from each other second indicator, each of said second indicators corresponding to one of said first indicators, providing a check folder having pockets to receive appropriately configured mounting tabs associated with said check book and with said check register, positioning said list and said check register via positioning the mounting tab thereof in one pocket in said check folder and positioning said book of checks via the positioning of the mounting tab thereof in the other pocket in said check folder adjacent said list so that said list is readily visible at an upper portion of said folder as a check is being written at the lower position of said folder, by reference to said list, selecting a first indicator corresponding to the one of those tax deduction categories to which category the intended recipient of the proceeds of a check to be written belongs, marking a second indicator on the face of a check which corresponds to the selected first indicator, thereby visually to identify the selected category of tax deduction on the face of the check and visibly to distinguish that check from other checks in other of said categories, entering the selected first indicator in said check register thereby to provide a visual indicator in said register for subsequently indicating in said register the location of a check subsequently indexed, then, after the cancelled check is returned to the maker, indexing the check according to tax deduction category with other marked checks in response to inspection of said second indicator.

* * * * *